United States Patent [19]

Kawai

[11] Patent Number: 4,848,207

[45] Date of Patent: Jul. 18, 1989

[54] LEVEL ADJUSTER FOR A MUSICAL INSTRUMENT

[75] Inventor: Takayuki Kawai, Hamamatsu, Japan

[73] Assignee: Yamaha Corporation, Japan

[21] Appl. No.: 105,873

[22] Filed: Oct. 7, 1987

[30] Foreign Application Priority Data

Oct. 13, 1986 [JP] Japan ..... 61-155651[U]
Oct. 13, 1986 [JP] Japan ..... 61-155652[U]

[51] Int. Cl.[4] ..... G10D 13/08
[52] U.S. Cl. ..... 84/403
[58] Field of Search ..... 84/403, 421, 422.3, 84/312 P; 428/188.2, 188.5, 326, 333

[56] References Cited

U.S. PATENT DOCUMENTS

| | | | |
|---|---|---|---|
| 2,021,080 | 11/1935 | Musser | 84/403 X |
| 2,245,883 | 6/1941 | Walberg | 84/421 |
| 2,626,118 | 1/1953 | Rice | 248/188.5 X |
| 2,746,664 | 5/1956 | Strmic | 248/188.5 X |
| 4,704,935 | 11/1987 | Franklin | 84/312 P |

*Primary Examiner*—L. T. Hix
*Assistant Examiner*—Brian W. Brown
*Attorney, Agent, or Firm*—Lerner, David, Littenberg, Krumholz & Mentlik

[57] ABSTRACT

Legs of a musical instrument are received in corresponding posts on a caster beam via slidable telescopic connection whose degree is changeable depending on the selected level of the musical instrument and uncontrolled fall of the musical instrument during level adjustment is mechanically prevented without any manual assistance for easier level adjustment.

3 Claims, 2 Drawing Sheets

LEVEL ADJUSTER FOR A MUSICAL INSTRUMENT

BACKGROUND OF THE PRESENT INVENTION

The present invention relates to an improved level adjuster for a musical instrument, and more particularly relates to an improvement in construction of a level adjuster for a musical instrument having one or more substantially horizontal top playing faces such as a marimba, a xylophone, a vibraphone and an electronic keyboard musical instrument.

In the case of these musical instruments, performance is greatly influenced by the level of the musical instrument in relation to player's body size and personal preference. In view of such special circumstances, a stand for a musical instrument of this type is usually constructed level adjustable. Most commonly, each leg of the stand is composed of two longitudinal pieces connected to each other, via set screws, for telescopic extension and contraction.

When the longitudinal pieces are set free for level adjustment by loosening of the set screws with this conventional construction, however, the musical instrument and its stand have to be held manually in order to allow free level adjustment. In particular when the musical instrument is very heavy, one can hardly complete the level adjustment without assistance by someone else.

SUMMARY OF THE INVENTION

It is the object of the present invention to provide a level adjuster for a musical instrument which enables easy level adjustment without any need for manually holding the musical instrument during the process of adjustment.

In accordance with the basic aspect of the present invention, each leg supporting a musical instrument is received in a post mounted to a caster beam on the floor via slidable, telescopic connection and accompanied with means for changing the degree of the telescopic connection for level adjustment of the musical instrument and means for fixing a selected degree of the telescopic connection.

DESCRIPTION OF THE PREFERRED EMBODIMENTS

Figure 1:
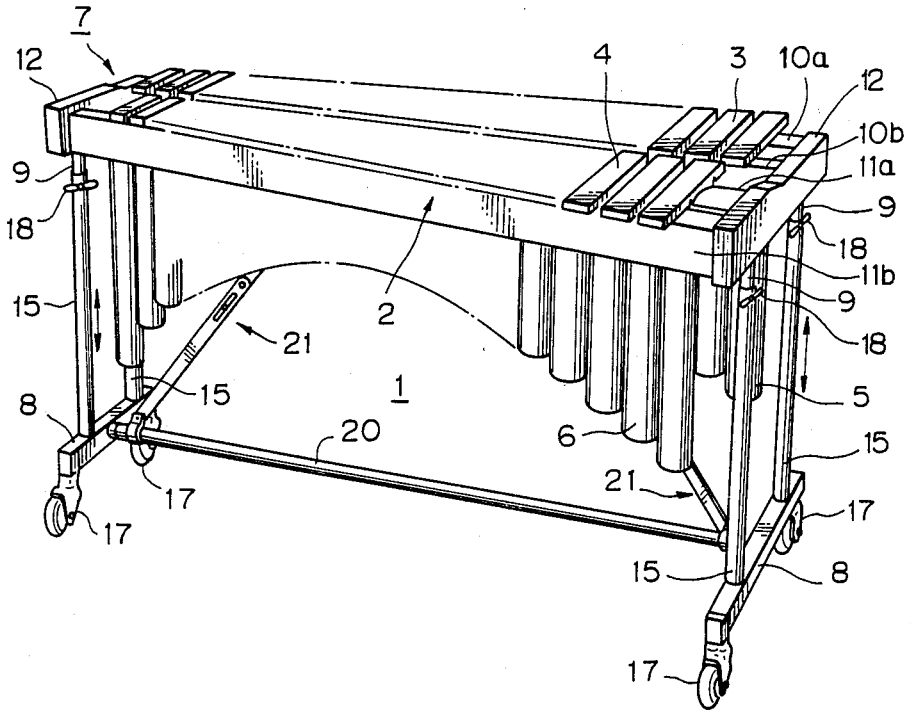
FIG. 1 is a perspective view of a marimba incorporating the level adjuster in accordance with the present invention.

In FIG. 1, a marimba 1 includes a main body 7 placed on a horizontal stand 2. The main body 7 includes two parallel tiers of sound bars 3 and 4 for generation of musical notes. The sound bars 3 and 4 are accompanied with resonator tubes 5 and 6 extending downwards, respectively. The stand 2 is supported at four corners by means of four extensible legs 9 mounted to respective caster beams 8 placed on the floor.

The stand 2 is made up of a pair of parallel long frames 10*a* and 10*b* arranged below the sound bars 3, a pair of parallel long frames 11*a* and 11*b* arranged below the sound bars 4, and a pair of opposite side frames 12 connected to both longitudinal ends of the long and short frames 10*a*, 10*b*, 11*a* and 11*b*.

Figure 2:
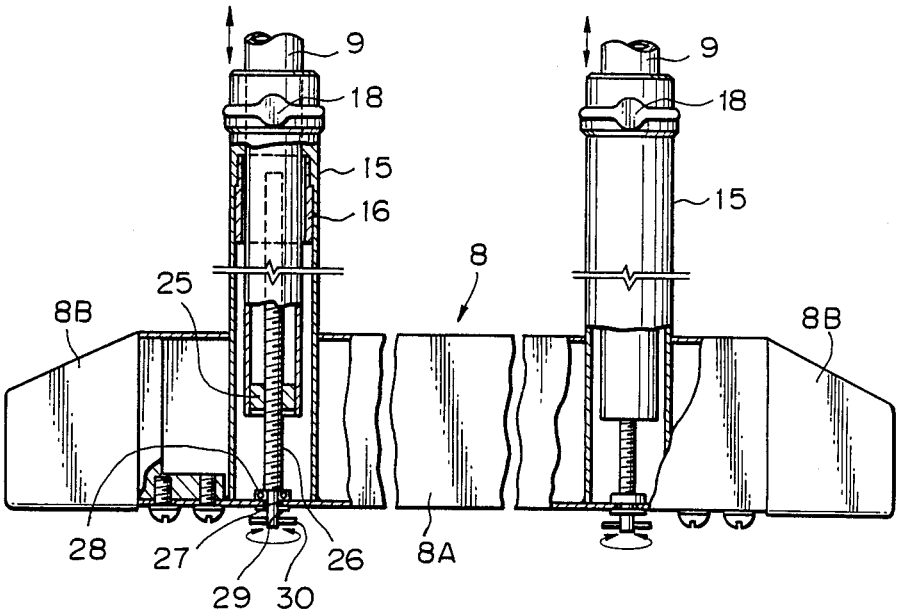
FIG. 2 is a side view, partly in section, of one embodiment of the level adjuster in accordance with the present invention.

One embodiment of the level adjuster in accordance with the present invention is shown in FIG. 2 which is seen from one lateral side of the marimba shown in FIG. 1. Each caster beam 8 is made up of an elongated block 8A and a pair of end covers 8B closing both open ends of the elongated block 8A. Corresponding to each leg 9 extending downwards from the stand 2, a hollow, cylindrical post 15 is arranged on the caster beam 8. More specifically, the lower end of the post 15 is inserted into the elongated block 8A and secured to the bottom plate of the latter whilst projecting upwards from the top face of the caster beam 8. The lower end of the leg 9 is inserted into the post 15 via a sleeve 16 in a telescopically slidable fashion. Within the post 15, the lower end of the leg 9 is closed by a nut 25 which is in screw engagement with a threaded rod 26. Facing the lower open end of the post 15, a through hole 27 is formed in the bottom plate of the block 8A and the lower end of the threaded rod 26 is axially turnably received in the through hole 27 via a bearing 28. An E-ring 29 is attached to the lower end of the threaded rod 26 in order to lock the same against longitudinal displacement. A pin 30 is also attached to the lower extension of the threaded rod 26 for manual turning of the latter.

Further, a fastener 18 is inserted over the junction between the leg 9 and the top end of the post 15 for tight connection between the two elements.

Returning to FIG. 1, each caster beam 8 is provided with a pair of casters 17 and the pair of caster beams 8 are connected to each other by a horizontal, connector pipe 20. The connector pipe 20 is connected to the main body 7 of the marimba 1 by means of a pair of stays 21 which are adjustable in length.

During performance of the marimba 1, the fastener 18 is placed in operation in order to keep the tight connection between the leg 9 and the post 15, i.e. the marimba 1 at a selected level.

For level adjustment, the fastener 18 is placed out of operation in order to cancel the tight connection between the leg 9 and the post 15 and the threaded rod 26 is turned axially via the pin 30. Following turning of the threaded rod 26, the nut 25 moves upwards or downwards with the associated leg 9 thereby changing the level of the marimba 1 as required. During this procedure, it is not necessary at all to manually hold the main body 7 of the marimba 1.

In a variant of the embodiment shown in FIG. 2, a compression coil spring may be interposed between the lower end of the sleeve 16 and the bearing 28 surrounding the lower end of the leg 9 and the threaded rod 26. Since this coil spring always pushes the leg 9 upwards via the sleeve 16, the threaded rod 26 can be turned easier for level adjustment.

Figure 3:
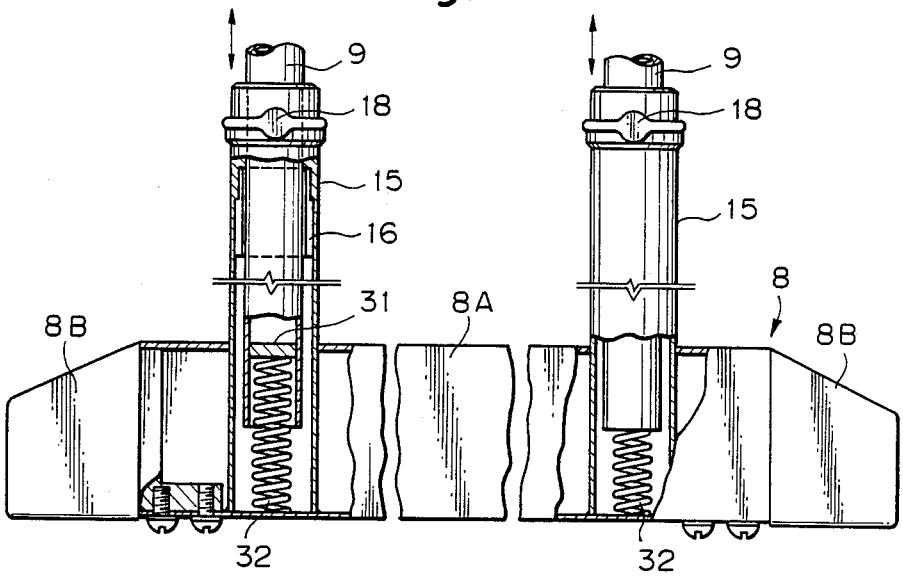
FIG. 3 is a side view, partly in section, of another embodiment of the level adjuster in accordance with the present invention.

Another embodiment of the level adjuster in accordance with the present invention is shown in FIG. 3, in which the basic construction is same as that shown in FIG. 2 except for absence of the threaded rod 26 and its associated parts. In this case, the leg 9 is closed by a closure 31 at a position somewhat above its lower end and a compression coil spring 32 is interposed between the closure 31 and the bottom plate of the elongated block 8A. The coil spring 32 always elastically pushes the leg 9 upwards. The intensity of this elastic upward force is chosen so that, without application of any external forces, this elastic upward force should keep the musical instrument at its own standard level. In this particular case, the spring constant of the coil spring 32 is chosen so that the marimba 1 should usually be kept at its standard level.

When it is wanted to lower the level of the musical instrument from this standard value, the fastener 18 is placed out of operation, the main body 7 of the marimba 1 is manually pushed down to a desired level against the repulsion of the coil spring 32 and, thereafter, the fastener 18 is again placed in operation in order to fix the selected level. For resumption of the standard level, the fastener 18 is again placed out of operation and the repulsion of the coil spring 32 automatically pushes the marimba 1 back to the standard level.

In modified embodiments of the present invention, the compression coil springs used in the foregoing embodiments may be replaced by proper elastic pushing means such as a dash pot using fluid or pneumatic pressure.

I claim:

1. A level adjuster for a musical instrument having a substantially horizontal playing surface supporting an instrument body therebelow and a plurality of legs supporting said substantially horizontal playing surface, said level adjuster comprising, a plurality of hollow, cylindrical post members corresponding to each of said plurality of legs, whereby each of said plurality of legs is telescopically receivable within one of said plurality of said post members, mounting means for mounting said plurality of post members at a fixed position, slide means for slidably displacing said plurality of legs with respect to said plurality of post members, each of said plurality of legs independently with respect to the remaining said plurality of legs, so as to alter the height of said substantially horizontal playing surface, said slide means including nut means affixed to said plurality of legs, said nuts means including a threaded aperture, and threaded rod means mounted on said mounting means and threadably engaged with said threaded aperture of said nut means whereby rotation of said threaded rod means causes axial displacement of said nut means therealong, and fixing means of fixing said plurality of legs at said altered height of said substantially horizontal playing surface.

2. The level adjuster as claimed in claim 1 including urging means for urging said plurality of legs away from said mounting means.

3. The level adjuster as claimed in claim 2 wherein said urging means comprises a compression spring mounted between said mounting means and said plurality of legs.

* * * * *